United States Patent [19]

Yamashita et al.

[11] Patent Number: 4,973,036

[45] Date of Patent: Nov. 27, 1990

[54] SHEET HANDLING APPARATUS PROVIDED FOR A COPYING MACHINE

[75] Inventors: Hiroki Yamashita; Keichi Kinoshita; Kazuhito Ozawa; Wataru Kurahashi; Katsuya Yasuda, all of Osaka, Japan

[73] Assignee: Minolta Camera Kabushiki Kaisha, Osaka, Japan

[21] Appl. No.: 310,602

[22] Filed: Feb. 14, 1989

[30] Foreign Application Priority Data

| | | | |
|---|---|---|---|
| Feb. 15, 1988 | [JP] | Japan | 63-33565 |
| Apr. 22, 1988 | [JP] | Japan | 63-99543 |
| Apr. 22, 1988 | [JP] | Japan | 63-54399[U] |

[51] Int. Cl.[5] ..... B42B 2/00

[52] U.S. Cl. ..... 270/53; 270/58

[58] Field of Search ..... 270/37, 53, 58; 327/120

[56] References Cited

U.S. PATENT DOCUMENTS

| | | | |
|---|---|---|---|
| 3,386,729 | 6/1968 | Pine . | |
| 3,645,615 | 2/1972 | Spear . | |
| 3,697,063 | 1/1972 | Greenfield et al. . | |
| 3,709,595 | 1/1973 | Turner et al. . | |
| 3,944,207 | 3/1976 | Bains . | |
| 4,067,649 | 1/1978 | Hubbard et al. . | |
| 4,073,391 | 2/1978 | O'Brien et al. . | |
| 4,076,408 | 2/1978 | Reid et al. . | |
| 4,123,155 | 10/1978 | Hubert . | |
| 4,134,672 | 1/1979 | Burlew et al. . | |
| 4,145,037 | 3/1979 | Mol . | |
| 4,180,197 | 12/1979 | Raasch | 227/120 |
| 4,190,246 | 2/1980 | Sasuga . | |
| 4,203,587 | 5/1980 | Kishi et al. . | |
| 4,218,128 | 8/1980 | Satomi et al. . | |
| 4,227,275 | 10/1980 | Söderberg . | |
| 4,238,066 | 12/1980 | Brooke . | |
| 4,248,413 | 2/1981 | Fox | 270/53 |
| 4,248,525 | 2/1981 | Sterrett . | |
| 4,265,440 | 5/1981 | Shibazaki et al. . | |
| 4,272,180 | 6/1981 | Satomi et al. . | |
| 4,281,920 | 8/1981 | Cross . | |
| 4,295,733 | 10/1981 | Janssen et al. . | |
| 4,313,670 | 2/1982 | Caldwell . | |
| 4,361,393 | 11/1982 | Noto . | |
| 4,365,886 | 12/1982 | Murakami et al. . | |

(List continued on next page.)

FOREIGN PATENT DOCUMENTS

| | | |
|---|---|---|
| 99250 | 1/1984 | European Pat. Off. . |
| 3218747 | 12/1982 | Fed. Rep. of Germany . |
| 3701450 | 7/1987 | Fed. Rep. of Germany . |
| 55-15150 | 2/1980 | Japan . |
| 57-72537 | 5/1982 | Japan . |
| 57-131667 | 8/1982 | Japan . |
| 57-203037 | 12/1982 | Japan . |
| 59-43765 | 3/1984 | Japan . |
| 60-183461 | 9/1985 | Japan . |
| 60-248563 | 12/1985 | Japan . |
| 61-145069 | 2/1986 | Japan . |
| 26061 | 6/1986 | Japan . |
| 61-261096 | 11/1986 | Japan . |
| 2185465 | 7/1987 | United Kingdom . |

OTHER PUBLICATIONS

Xerox Disclosure Journal, vol. 2, No. 5, Sep./Oct. 1977.

*Primary Examiner*—Carl D. Price
*Assistant Examiner*—Therese M. Newholm
*Attorney, Agent, or Firm*—Burns, Doane, Swecker & Mathis

[57] ABSTRACT

A sheet handling apparatus comprising a stapling tray for receiving sheets ejected from a copying machine and a stamp for stamping on the sheets in the stapling tray, wherein the surface of the stapling tray facing the stamp is made of soft and elastic material to reduce friction. The sheets are selectively stapled or stapled and stamped, and the stamping operation is performed after the stapling operation. Further, the sheet handling apparatus comprises an ejection tray for receiving sheets ejected for the copying machine, an elevate block for elevating and lowering the ejection tray, a linking mechanism for actuating the stamp to stamp on the sheets in connection with the movement of the ejection tray driven by the elevate block.

10 Claims, 14 Drawing Sheets

U.S. PATENT DOCUMENTS

| | | |
|---|---|---|
| 4,368,972 | 1/1983 | Naramore . |
| 4,371,155 | 2/1983 | Asterö et al. . |
| 4,376,529 | 3/1983 | George et al. . |
| 4,385,827 | 5/1983 | Naramore . |
| 4,411,515 | 10/1983 | Kukucka et al. . |
| 4,424,963 | 1/1984 | Bartholet et al. . |
| 4,473,425 | 9/1984 | Baughman et al. . |
| 4,497,478 | 2/1985 | Reschenhofer et al. . |
| 4,515,458 | 5/1985 | Masuda et al. . |
| 4,549,804 | 10/1985 | Braun et al. . |
| 4,564,185 | 1/1986 | Hamlin et al. . |
| 4,566,782 | 1/1986 | Britt et al. . |
| 4,573,789 | 3/1986 | Wada . |
| 4,582,421 | 4/1986 | Hamlin et al. . |
| 4,592,651 | 6/1986 | Oikawa et al. . |
| 4,595,187 | 6/1986 | Bober . |
| 4,603,971 | 8/1986 | Kukucka et al. . |
| 4,626,156 | 12/1986 | Baughman et al. . |
| 4,647,034 | 3/1987 | Sawa . |
| 4,647,188 | 3/1987 | Komiya et al. . |
| 4,674,732 | 6/1987 | Hori . |
| 4,674,866 | 6/1987 | Tanaka . |
| 4,687,191 | 8/1987 | Stemmle . |
| 4,702,589 | 10/1987 | Ito . |
| 4,718,657 | 1/1988 | Otter et al. . |
| 4,721,382 | 1/1988 | Ito et al. . |
| 4,730,206 | 3/1988 | Sawada et al. . |
| 4,743,945 | 5/1988 | Ito et al. . |
| 4,763,889 | 8/1988 | Dei et al. . |

SHEET HANDLING APPARATUS PROVIDED FOR A COPYING MACHINE

FIELD OF THE INVENTION

The present invention relates to a sheet handling apparatus, particularly, a sheet handling apparatus where sheets ejected from an image forming apparatus such as a copying machine are stored, aligned and stapled therein.

BACKGROUND OF THE INVENTION

Sheets ejected from an image forming apparatus such as a copying machine, a laser beam printer or the like sometimes need to be stamped with "SECRET", "CIRCULAR NOTICE" etc. Various types of sheet handling apparatus having a stapling function and various types of stamping means for stamping on copying paper have been ever commercialized. The Japanese Patent Laid Open Publication No. 55-15150 discloses a copying machine wherein a stamp is arranged behind a fixing device therein to stamp on sheets of copying paper at the position automatically.

However, conventionally, since the stapling operation and the stamping operation have been performed by different devices, separate spaces for the different devices have been needed, and the effective use of space has not been made. Also, if sheets are stamped while being transported, the position to be stamped at may be skewed owing to the skew of the sheets, and a paper jam may be caused. Further, if a stamping function is just added to a conventional sheet handling apparatus having a stapling function, a driving device for the stamping function has to be disposed separately, and the copying operation may have to be interrupted while the stamping function is performed.

SUMMARY OF THE INVENTION

In view of the above-mentioned problems, an object of the present invention is to provide a sheet handling apparatus wherein stapling means and stamping means can be disposed spatially effectively, sheets can be stamped at a specified position, and a paper jam is never caused by the stamping operation.

Another object of the present invention is to provide a sheet handling apparatus wherein, when stamping means is provided for a tray for stapling sheets therein, the reception, the alignment and the ejection of the sheets are never obstructed, and the sheets can be stamped neatly.

The other object of the present invention is to provide a sheet handling apparatus wherein stamping means is provided for a sheet handling apparatus having stapling means without the necessity of a special driving device for the stamping means nor without any bad effect such as the interruption of the copying operation etc.

To attain the above-mentioned objects, a sheet handling apparatus according to the present invention comprises a tray for receiving sheets ejected from an image forming apparatus, means for aligning the sheets received by the tray, means for stapling the aligned sheets and means for stamping on the sheets received by the tray. Sheets ejected from the image forming apparatus are received by the tray, aligned therein, stapled by the stapling means and then stamped if necessary. The stamping means is operated after the stapling operation, preferably, without a distinct time lag so that the delay owing to the stamping operation can be prevented. That is, the time required for the stamping operation is assimilated to the time required for the stapling operation, and the image forming operation is never forced to delay because of performing the stamping operation. Also, the surface of the tray facing to the stamp is made of elastic material to reduce friction, so that the neat stamping can be guaranteed and that the reception, the alignment and the ejection of the sheets can be prevented from being obstructed.

Further, a sheet handling apparatus according to the present invention comprises a first tray and a second tray for receiving sheets ejected from an image forming apparatus, means for transporting the sheets selectively to the first tray or the second tray, elevate means for elevating and lowering the first tray to and from the ejection portion of the transport means, means for stapling the sheets received by the second tray, means for stamping on the sheets received by the second tray and means for operating the stamping means to stamp on the sheets in connection with the movement of the first tray driven by the elevate means. With this constitution, the first tray is moved down appropriately by the elevate means in connection with the increase of the sheets in volume thereon. On the other hand, the stamping operation on the sheets is performed synchronized with the stapling operation. The stamp is actuated to stamp on the sheets in connection with the descent of the first tray to a specified position. Thus and so, the driving system for the stamping means can be simplified by making use of the elevate means provided for the first tray. Additionally, in the case of the stapling operation, since sheets are not stored on the first tray, the movement of the first tray causes no trouble.

BRIEF DESCRIPTION OF THE DRAWINGS

These and other objects and features of the present invention will become apparent from the following description taken in conjunction with the preferred embodiment thereof with reference to the accompanying drawings, in which.

the drawings show an embodiment of a sheet handling apparatus according to the present invention.

DETAILED DESCRIPTION OF THE EMBODIMENT

An embodiment of a sheet handling apparatus according to the present invention is described below referring to the accompanying drawings.

(GENERAL CONSTITUTION INCLUDING THE COPYING MACHINE)

Figure 1:
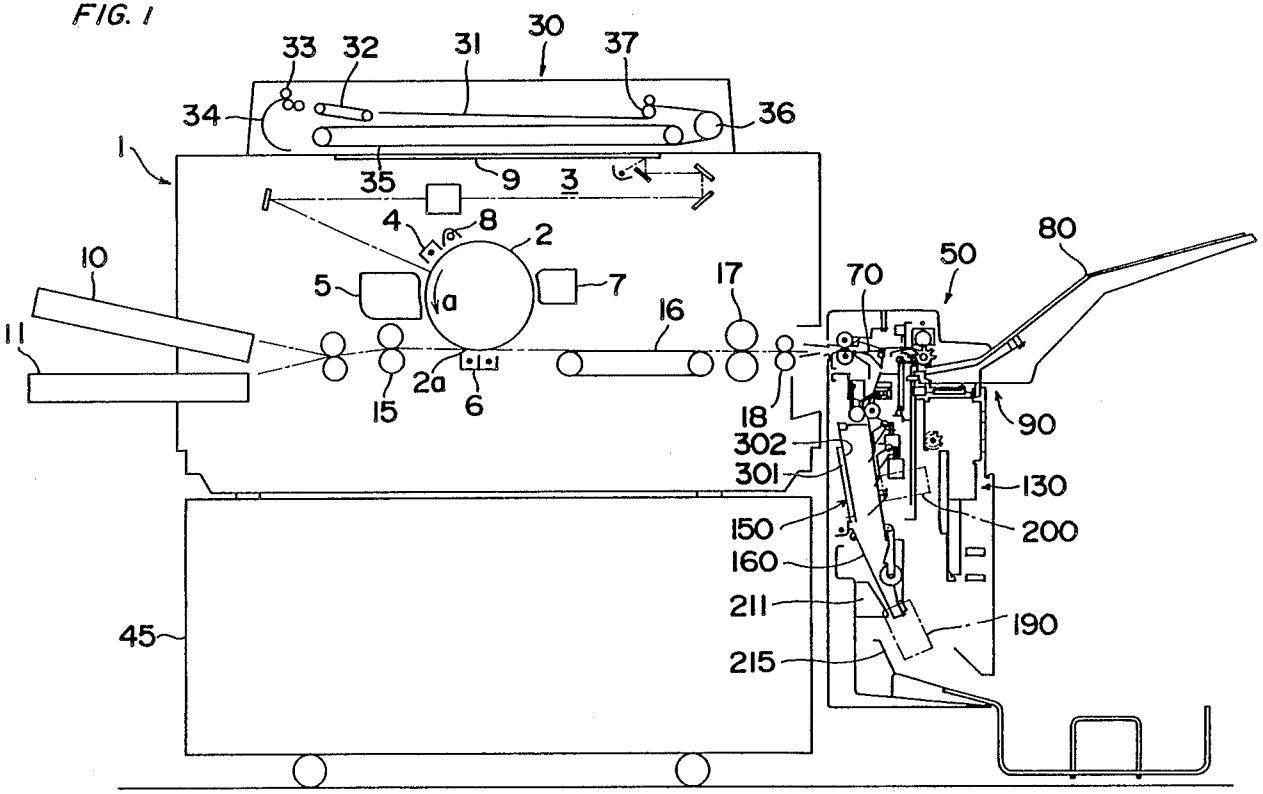
FIG. 1 is a schematic block diagram including a copying machine.

First, the general constitution including a copying machine 1 is described referring to FIG. 1.

The copying machine 1 is placed on a desk 45, and a recirculating document handling device 30 (which is hereinafter abbreviated to RDH) is disposed on the upper surface thereof. In the center of the copying machine 1, a photosensitive drum 2 is disposed. Around the drum 2, elements for image forming such as an optical system 3, an electrifying charger 4, a developing device 5, a transfer charger 6, a cleaning device 7, an eraser lamp and so on are arranged. These elements and the operation system of the elements are so well-known that the detailed description of them is omitted.

Copying paper which is loaded in automatic paper feeder cassettes 10 and 11 is fed sheet by sheet selectively from the cassette 10 or 11. A sheet of copying paper is transported to a transfer portion 2*a* by a pair of timing rollers 15, synchronized with a toner image on the circumferential surface of the photosensitive drum 2. After the transfer processing, the sheet is supplied to a fixing device 17, where the toner image is fixed on the sheet, by a conveyer belt 16, and then the sheet is ejected therefrom by a pair of ejection rollers 18. At that time, the sheet is detected by a sensor SE1 disposed immediately before the ejection rollers 18.

The RDH 30 generally comprises a document tray 31, a document feed belt 32, a pair of document feed rollers 33, a diverting guide plate 34, a transport belt 35, a diverting roller 36 and a pair of ejection rollers 37. The RDH 30 transports a set of documents one by one in order of page starting with the last page. A set of documents should be placed on the tray 31 with the last page faced down at the bottom, so that the documents are drawn out one by one in order from the last page by the rotation of the document feed belt 32 and fed between the transport belt 35 and a document deck glass 9 through the pair of document feed rollers 33 and the diverting guide plate 34. Next, the document is set at a specified position on the document glass 9 by the travel of the transport belt 35 to be exposed by the conventional optical system 3. After the image exposure, the document is transported by the transport belt 35 from the document deck glass 9 toward the right side in FIG. 1, where the document is diverted by the diverting roller 36, and ejected by the pair of ejection rollers 37 onto a stack of documents on the tray 31 with the surface having an image upward.

Incidentally, one cycle of copying operation is defined as one sequence of image exposure that all the documents placed on the tray 31 are once exposed. The number of documents and the number of copy sets to be made can be inputted with input means (ten-key) on an operation panel on the copying machine 1. Each time one cycle of copying operation for one set of documents is completed, an ejection tray 80 is shifted as described later, or the documents are circularly transported as described above to repeat cycles of copying operation up to the number of copy sets inputted with the input means while the copying operation is discontinued to execute a stapling operation and a stamping operation, corresponding to the operation mode of a finisher unit 50.

A sheet handling apparatus, in this embodiment, corresponds to the finisher unit 50 wherein sheets ejected from the copying machine 1 are selectively stacked on the ejection tray 80 or stored in a stapling tray 150 to be aligned and stapled by a stapler 190. Accordingly, in the case of making a plurality of copy sets processed by the stapling operation and the stamping operation with use of the RDH 30, one set of copying paper is stored in the stapling tray 150 at the time of the output of a one cycle completion signal, and after the alignment of the last sheet, the stapler 190 and the stamp 200 are operated to staple and stamp the copy set. The stapled set is stacked and stored in a stack box 220.

(CONSTITUTION OF THE FINISHER UNIT)

Figure 2:
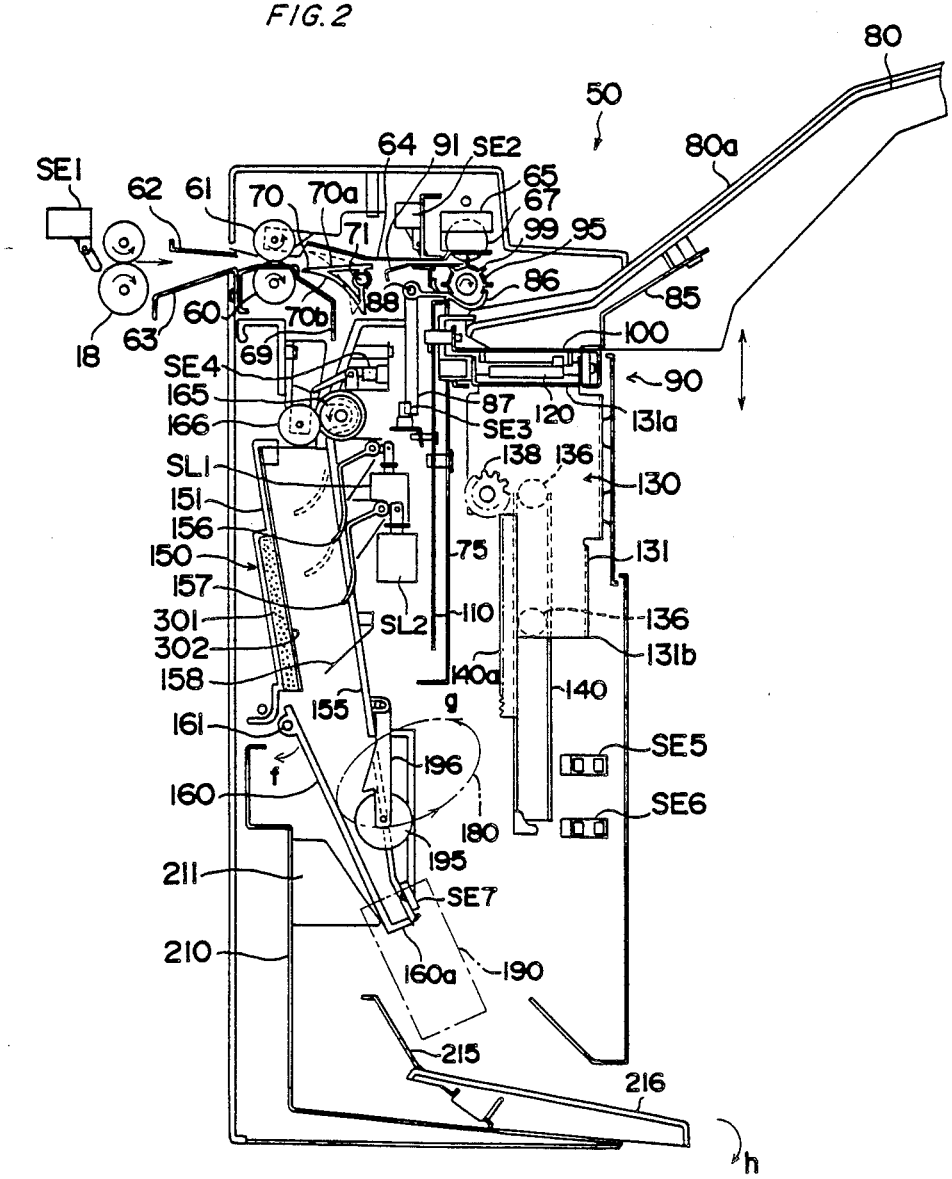
FIG. 2 is an internal construction showing a finisher unit.
Figure 11:
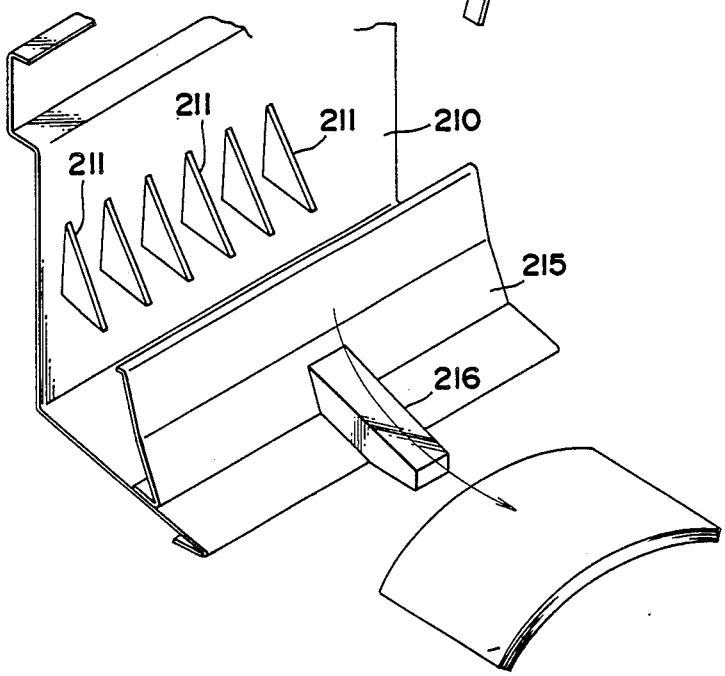
FIG. 11 is a perspective view showing a sheet ejection portion of the stapling tray.

Next, the constitution of the finisher unit 50 is herewith described referring to FIGS. 2 and 11.

This finisher unit 50 is generally composed of rollers 60 and 61 for receiving copying paper, a diverting member 70 for diverting the transport pass, an ejection tray 80, a shift block 90 for shifting the ejection tray 80 in the direction crossing the direction of the sheet ejection at a right angle each time one set of copying paper corresponding to a set of documents is stacked thereon, an elevate block 130 for lifting down the ejection tray 80 at intervals to keep the falling rate of sheets of copying paper down onto the ejection tray 80, the stapling tray 150 having a stapling function and a stamping function, said stack box 220 for stacking and storing the bound sheets ejected from the stapling tray 150, and a guide plate 215 for guiding the falling bound sheets.

The portion where copying paper is received is provided with guide plates 62 and 63 opposed to the pair of ejection rollers 18 as well as the driving roller 60, the accompanying roller 61. In the finisher unit 50, further, the diverting member 70, guide plates 64, 69 and 91, a sensor SE2 for detecting copying paper being ejected onto the ejection tray 80 are set.

The bill-shaped diverting member 70 is disposed so as to pivot on a shaft 71, and the diverting member 70 shifts its position from that shown by a solid line to that shown by a dashed line in FIG. 2 when a solenoid not shown by the drawings is turned on. When the diverting member 70 is at the position shown by the solid line, its upper surface 70*a* guides copying paper to the ejection tray 80, and when it is shifted to the position sown by the dashed line, its curved surface 70*b* guides copying paper to the stapling tray 150.

Figure 3:
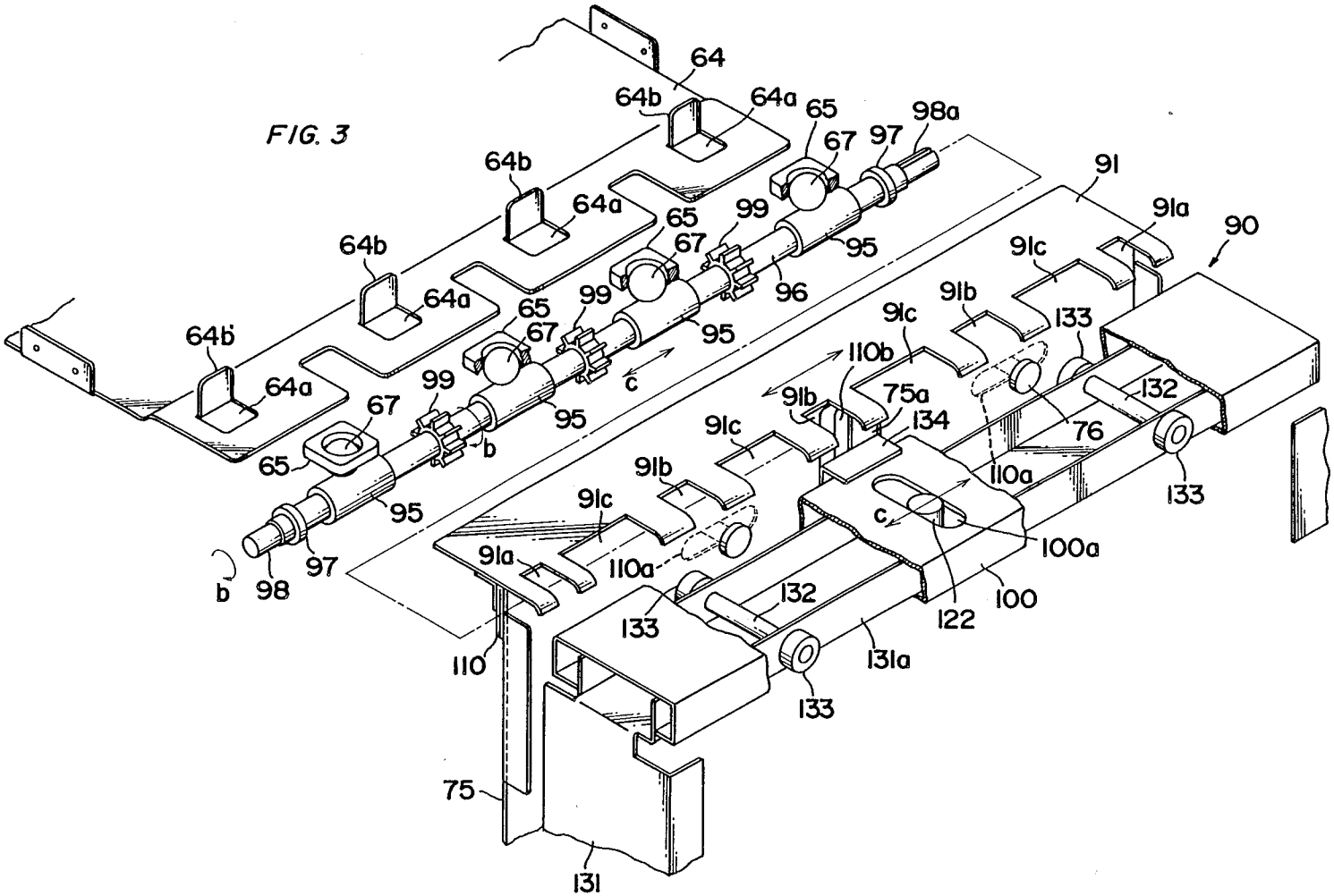
FIG. 3 is an exploded view in perspective showing ejection rollers and a shift block.

Copying paper is ejected onto the ejection tray 80, as shown in FIG. 3, by ejection rollers 95 and balls 67, and the ejected sheet is aligned by paddle wheels 99 which are disposed on the same shaft as the ejection rollers 95 are. The paddle wheels 99, which are equipped with radially-arranged flexible blades, provides the force in the direction reverse to that of the sheet ejection with the trailing edge of the sheet ejected onto the ejection tray 80 and presses the trailing edge of the sheet against a fixed back plate 75 to align the sheet.

Figure 5:
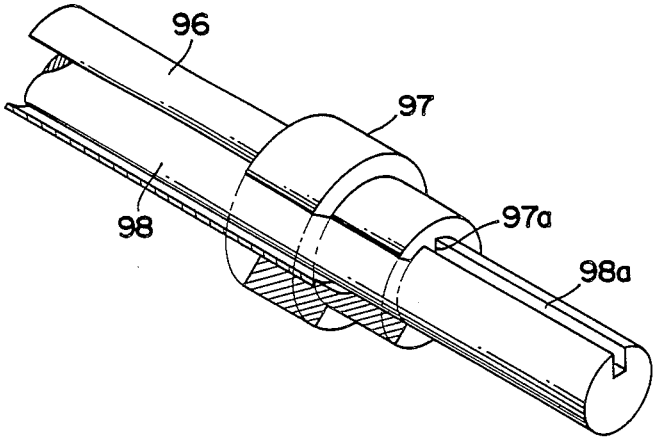
FIG. 5 is a perspective view showing a supporting mechanism for the ejection rollers and paddle wheels.

In this embodiment, the ejection tray 80 is shifted at a specified timing to divide copying paper into sets. Accordingly, the paddle wheels 99 which always touch the trailing edge of a sheet need to be shifted synchronized with the shifting of the ejection tray 80 in order not to put the sheet out of alignment. So, the paddle wheels 99 and the ejection rollers 95 are constructed so as to be shifted in a body. That is, the paddle wheels 99 and the ejection rollers 95 are fixed to a cylindrical shaft 96, and the shaft 96 is loosely disposed to a shaft 98 which is rotatably disposed to a frame not shown in the drawings. The shaft 98 can rotate in the direction of arrow (b) by a transport motor not shown in the drawings, and a key way 98*a* formed on the shaft 98 is engaged with key 97*a* shown in FIG. 5 disposed on each of ring shaped stoppers 97 fixed to the both ends of the shaft 96. Accordingly, the paddle wheels 99 and the ejection rollers 95 are driven to rotate in the direction of arrow (b) in a body and can be shifted in the direction of arrow (c). The shifting of the paddle wheels 99 and the ejection rollers 95 follows that the stoppers 97 are engaged with notches 91*a* on the bottom guide plate 91 so that the bottom guide plate 91 is shifted in the direction of arrow (c) together with the shift block 90 as described later. Also, the paddle wheels 99 and the ejection rollers 95 are positioned at notches 91*b* and 91*c* on the bottom guide plate 91 respectively.

Further, when the paddle wheels 99 are shifted accompanying the shifting of the ejection tray 80, they are stopped rotating. If the paddle wheels 99 are driven to rotate in the direction of arrow (b) at the time of shifting, the trailing edge of the top sheets of copying paper is pressed against the fixed back plate 75 by the force of the paddle wheels 99, and the sheet is left behind with the shifting. As a result, the sheets are put out of alignment. Consequently, the paddle wheels 99 are stopped rotating to prevent this trouble. The paddle wheels 99 are stopped rotating by the stoppage of rotation of the transport motor.

Figure 4:
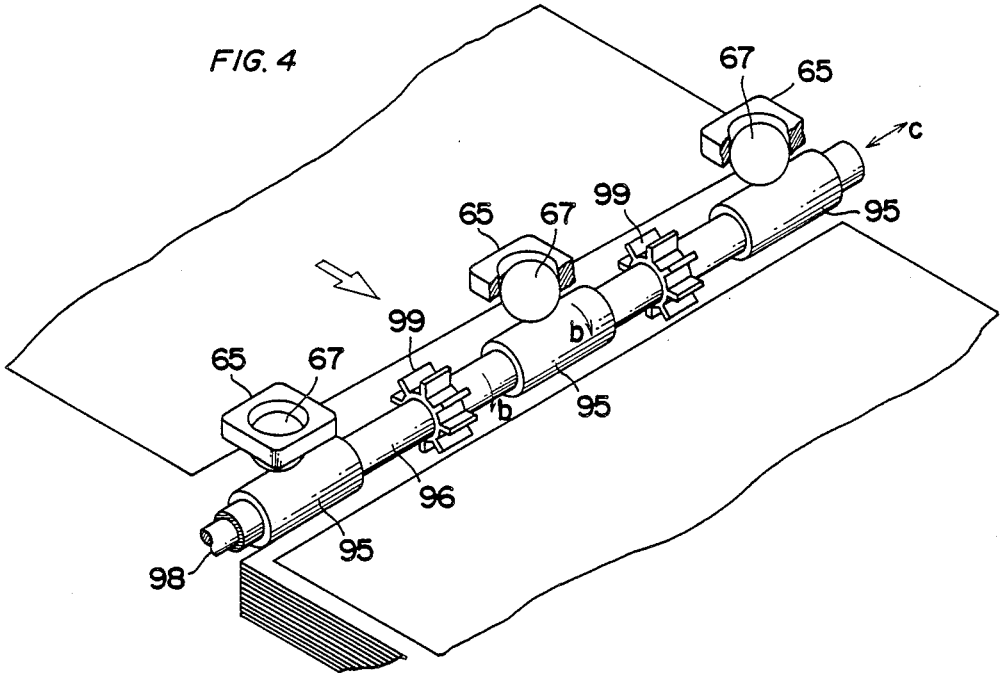
FIG. 4 is a perspective view showing sheet transport condition onto a ejection tray.

On the other hand, the balls 67 which can rotate are pressed on the ejection rollers 95 by their own weight respectively. That is, as shown in FIGS. 3 and 4, the balls 67 are positioned at openings 64*a* formed on a top guide plate 64 respectively and are prevented from moving by holders 65 fixed on tabs 64*b* cut out at the openings 64*a*. The balls 67 can accompany the rotation and the shifting of the ejection rollers 95 within the holders 65 so as to nip a sheet of copying paper in cooperation with the ejection rollers 95 to feed the sheet onto the ejection tray 80.

As shown in FIG. 2, the ejection tray 80 has a plurality of linear protrusions 80*a* extending in the direction of the sheet ejection on its surface and mounted on a shift frame 100 by a supporting plate 85. The back end of the ejection tray 80 touches the top portion of the fixed back plate 75, and an actuator 86 for a sensor SE3 is disposed above it. The actuator 86 can pivot on a shaft 88 in a body together with a lever 87, the bottom portion of the lever 87 usually intercepts the optical axis from the sensor SE3. When the number of sheets stacked on the ejection tray 80 increases, so that the sheets push up the actuator 86, the lever 87 pivots counterclockwise in FIG. 2 on the shaft 88 together with the actuator 86 so that the optical axis from the sensor SE3 which has been intercepted by the bottom portion of the lever 87 penetrates. Thus, the level of the surface of the top sheet of copying paper is detected, and the elevate block 130 is operated as described later so as to move down the ejection tray 80.

(SHIFT BLOCK)

Figure 6:
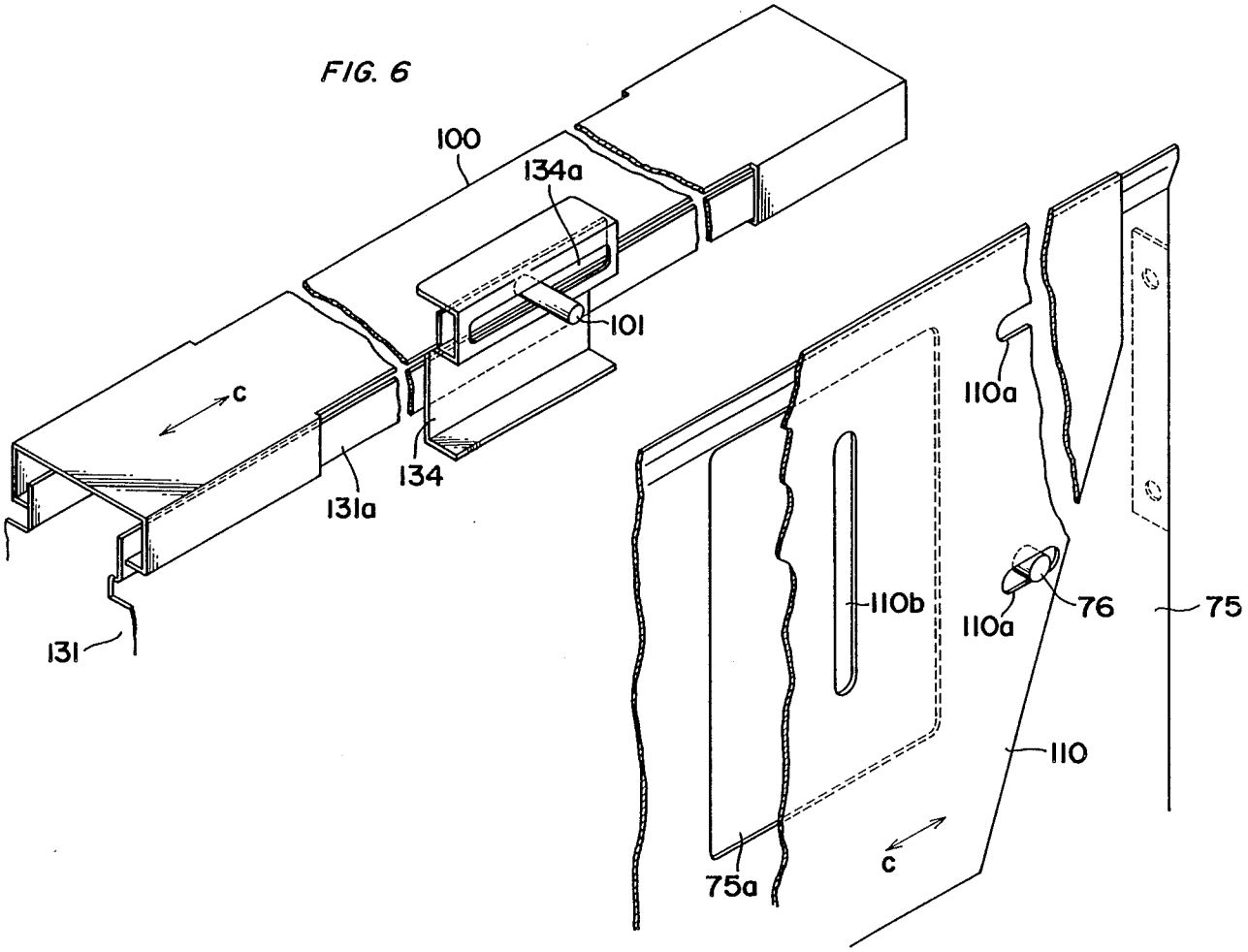
FIG. 6 is an exploded view in perspective showing the shift block.
Figure 8:
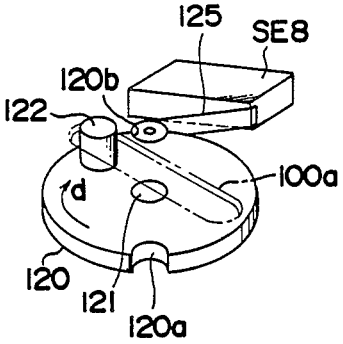
FIG. 8 is a perspective view showing a shift cam.

The shift frame 100 on which the ejection tray 80 is disposed, as shown in FIGS. 3 and 6, can be shifted in the direction of arrow (c) guided by guide rollers 133 which are rotatably provided with shafts 132 through a lateral guide portion 131*a* of an elevate frame 131. A cam 120 shown in FIG. 8 is set inside the lateral guide portion 131*a*, and a pin 122 fixed on an edge of the cam 120 is engaged with a long hole 100*a* on the shift frame 100. The cam 120 can be driven to pivot in the direction of arrow (d) on a shaft 121 by a shift motor not shown in the drawings, and recesses 120*a* and 120*b* which are located with the point symmetry at an angle of 180 degrees to each other are formed on the circumferential surface of the cam 120. Also, an actuator 125 for a sensor SE8 is arranged on the circumference of the cam 120, and the sensor SE8 works each time the actuator 125 falls down to the recess 120*a* or 120*b* during the rotation of the cam 120.

With the above-described arrangement, one cycle of copying operation with use of the RDH 30 is completed; the last sheet of a set of copying paper corresponding to a set of original documents is ejected onto the ejection tray 80; the shift motor is started to drive so that the cam 120 rotates in the direction of arrow (d); the actuator 125 falls down into the recess 120*a* or 120*b*; and then the shift motor is turned off. Thus and so, the cam 120 rotates at an angle of 180 degrees intermittently each time a specified number of sheets is fed onto the ejection tray 80, and the shift frame 100 repeats to be reciprocated via the pin 122 together with the ejection tray 80 in the direction of arrow (c), that is, in the direction of intersecting at a right angle with the direction of the sheet ejection.

Further, the fixed back plate 75 and a movable back plate 110 are mounted on the back side of the shift frame 100. The fixed back plate 75 is fixed to the main frame of the finisher unit 50, and it regulates the trailing edges of sheets transported onto the ejection tray 80. The movable back plate 110 functions to shift the ejection rollers 95, the sensor SE3 and the actuator 86 synchronized with the shifting of the ejection tray 80, and the bottom guide plate 91 is fixed to this movable back plate 110.

More specifically, as shown in FIGS. 3 and 6, three pins 76 disposed on the fixed back plate 75 engage with long holes 110*a* formed on the movable back plate 110 so that the movable back plate 110 can be shifted in the direction of arrow (c). Also, a pin 101 disposed on the shift frame 100 engages with a long hole 110*b* vertically formed on the movable back plate 110 through a long hole 134*a* on a guide plate 134 fixed to the lateral guide portion 131*a* of the elevate frame 131 and an opening 75*a* on the fixed back plate 75. Accordingly, the movable back plate 110 can be shifted in the direction of arrow (c) together with the shift frame 100 and the ejection tray 80 by the engagement of the pin 101 with the long hole 110*b*. Also, the movable back plate 110 is guided to be shifted by the engagement of the lateral long holes 110*a* with the pins 76. On the other hand, when the shift frame 100 is moved up and down together with the ejection tray 80 by the operation of the elevate block 130 as described later, the movable back plate 110 maintains its vertical position and does not move up and down since the pin 101 is guided by the long hole 110*b*. That is, the ejection rollers 95 and the actuator 86 vertically maintain their positions.

(ELEVATE BLOCK)

The elevate block 130 supports the shift block 90 and is designed to lift up and down the ejection tray 80.

Figure 7:
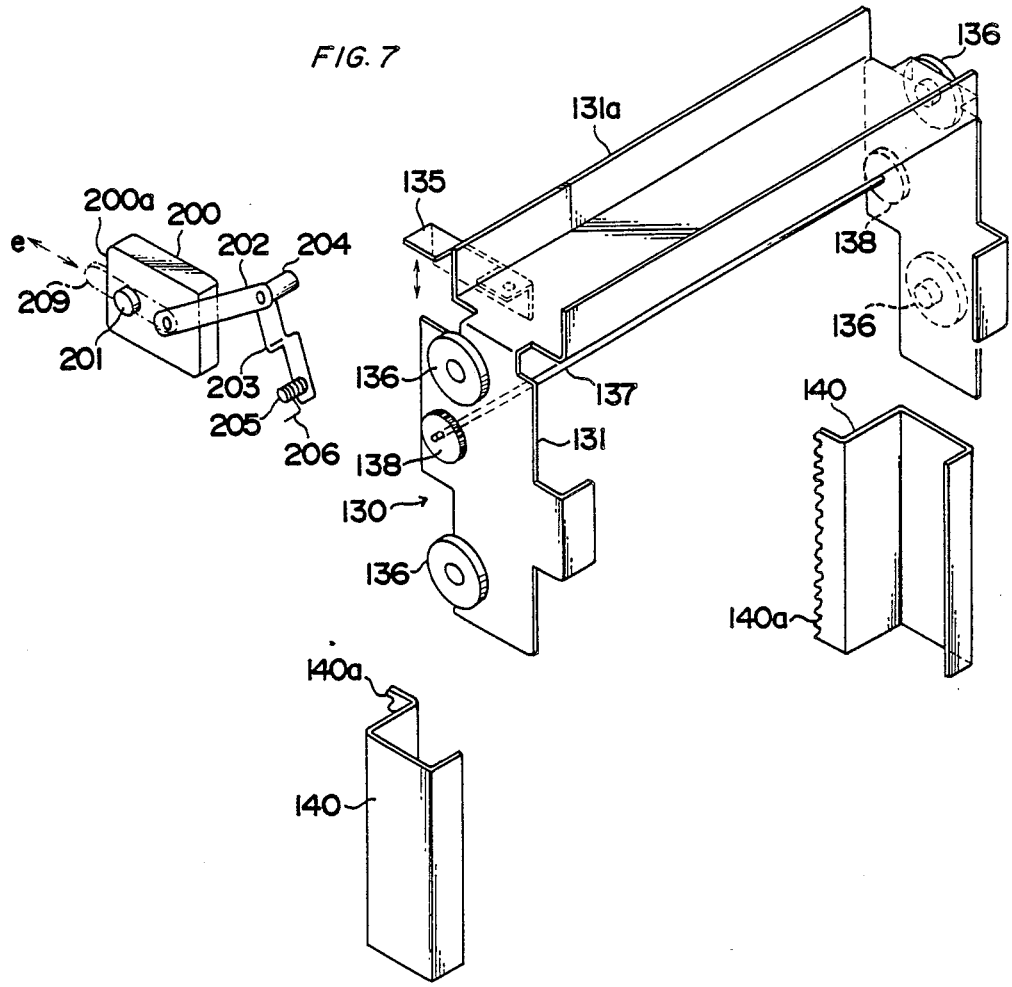
FIG. 7 is a perspective view showing an elevate block.

The elevate frame 131, which supports the shift frame 100 and enables it to be shifted, as shown in FIG. 7, can be lifted up and down by the engagement of rotatable rollers 136 disposed on the both sides of the elevate frame 131 with the inside of guide frames 140 fastened to the main frame not shown in the drawings. This elevate frame 131 also has pinions 138 fastened to a shaft 137. These pinions 138 gear to racks 140*a* formed on the elevate guide frames 140 and are driven to rotate by a reversible elevate motor not shown in the drawings. The elevate frame 131 is moved up and down together with the shift frame 100 and the ejection tray 80 by the rotation of the pinions 138.

With the arrangement as described above, when the number of sheets ejected and stacked on the ejection tray 80 increases, and the upper surface of the copying paper lifts up the actuator 86 to operate the sensor SE3, the elevate motor is driven forward. Then, the elevate frame 131 is moved down together with the ejection tray 80. When the actuator 86 comes back to its place by the descent of the copying paper accompanying the descent of the ejection tray 80, so that the lever 87 intercepts the optical axis from the sensor SE3 again, the descent of the elevate frame 131 is stopped by the stoppage of the drive of the elevate motor. Thus and so, since the ejection tray 80 is intermittently moved down according to the volume of copying paper stacked thereon, the height which the trailing edge of a sheet falls down to the ejection tray 80 is automatically maintained within that calculated by the addition of the distance which the ejection tray 80 is moved down during the drive of the elevate motor to the distance between the nipping portion formed of the ejection rollers 95 and the balls 67 and the position where the actuator 86 detects the upper surface of the copying paper. The sheets of copying paper keep in alignment by the descent of the ejection tray 80 as well as by the aligning operation of the paddle wheels 99.

On the other hand, as shown in FIG. 2, sensors SE5 and SE6 are disposed under the elevate block 130. These sensors SE5 and SE6 function when a corner 131*b* of the elevate frame 131 intercepts the optical axes therefrom. When the sensor SE5 is actuated and the sensor SE3 detects the upper surface of the copying paper, which means that the ejection tray 80 fills with paper, a signal which indicates sheets of copying paper are stacked over the capacity is outputted to the copying machine 1, and if necessary, it is warned that the sheets should be taken away from the ejection tray 80.

Further, even when the sensor SE5 detects the descent of the elevate block 130, the elevate block 130 can afford to be moved down approximately 10 millimeters more. Accordingly, in this embodiment, even if the signal indicating the overstacking of copying paper is outputted in the middle of a cycle of copying operation with use of the RDH 30, the copying operation is not immediately discontinued but is controlled to be discontinued after the completion of the current cycle of copying operation. If copying operation is discontinued in the middle of its one cycle, the division of copying paper into sets by the shifting of the ejection tray 80 comes in vain, and also an operator should set the remaining documents of the set to resume the copying operation or should operate to make one more whole set. However, such trouble and inconvenience are prevented with this control system. The detailed procedure of this control system will be described later.

Additionally, the elevate frame 131 is moved down until its corner 131*b* is detected by the sensor SE6 so as to actuate the stamp 200.

(STAMP BLOCK)

The constitution of the stamp block is herewith explained.

The stamp 200 shown in FIGS. 7 and 10 stamps the words "SECRET", "CIRCULAR NOTICE" etc. on a bundle of copying paper stored in the stapling tray 150 described later. This stamp 200 is arranged so as to face a stamp receiving position disposed to an edge (where sheets are regulated) of a base plate 151 of the stapling tray 150 and is driven by the elevate frame 131. The stamp 200 is set with its stamping surface 200*a* facing arrow (e), and a pin 201 can move in the direction of arrow (e) along a guide hole 209. This stamp 200 is linked with links 202 and 203 connected with each other by a pin 204, and the link 203 can pivot on a pin 205 and is always hung up by a coil spring 206.

A tab 135 which is fixed onto the lateral guide portion 131*a* of the elevate frame 131 presses the pin 204 by the descent of the elevate frame 131 to its lowest position, and the stamp 200 is moved in the direction of arrow (e) to stamp on the sheets in the stapling tray 150. The stamping operation is controlled to be executed immediately after the stapling operation by the stapler 190 as described later. The sensor SE6 is actuated at the time of stamping operation, and accordingly the elevate motor is driven in the reverse direction to lift up the elevate frame 131 to its initial position. The links 202 and 203 relieved from the pressure of the tab 135 are moved up by the elasticity of the coil spring 206 so that the stamp 200 returns to its initial position.

Additionally, the stamp 200 and its driving mechanism do not always have to be the ones as described above, and for example, the stamp 200 can be constructed so as to be driven by a solenoid or the like.

(STAPLING TRAY)

The stapling tray 150, as shown in FIG. 2, is composed of the base plate 151, a guide plate 155 and a stopper 160 and stands with a slight inclination. At an edge of the base plate 151, the stamp receiving position is disposed facing the stamp 200. The stamp receiving position is made of soft and elastic material whose coefficient $\mu$ of friction against the sheets is low so that the reception of the sheets into the tray 150, the alignment of the sheets therein and the ejection of the sheets therefrom can not be obstructed. Also, the surface of the stamp receiving position is smooth and is maintained approximately at the same height as that of the tray 150 so as not to protrude from the surface of the tray 150.

More specifically, in this embodiment, the stamp receiving position is composed of a soft sponge 301 on which a polyester sheet 302 is stuck.

Additionally, the stamp receiving position as mentioned above is not the only one, and various types such as one made of silicone rubber, one made of rubber material on which a polyester sheet is stuck, one made of elastic material on which paint is put to reduce friction and others are available. That is, the stamp receiving position should be made of elastic material so that the sheets can be stamped clearly without being affected by the slight inclination of the stamp 200, the curl of the sheets, the thickness of the bundle of sheets etc. Since the coefficient of friction between the sheets is about 0.3 through 0.7, usually 0.4, the coefficient of friction between the surface of the stamp receiving position and the sheets is preferably less than 0.4, more preferably, less than 0.3. In this embodiment, the coefficient of friction between the polyester sheet and the sheets of copying paper is approximately 0.2 through 0.3.

The stopper 160 for regulating the bottom of sheets transported into the stapling tray 150 can pivot on a shaft 161 and is connected with an ejection solenoid not shown in the drawings. The stopper 160 usually closes the bottom of the stapling tray 150 engaging with the bottom portion of the guide plate 155 when the ejection solenoid is off. When the ejection solenoid is turned on, the stopper 160 is turned in the direction of arrow (f) on the shaft 161 to open the bottom of the stapling tray 150.

Figure 9:
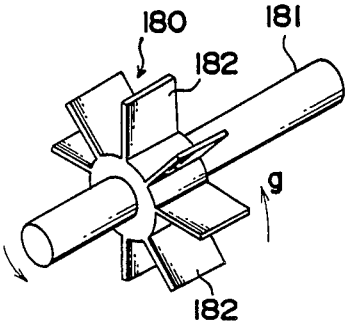
FIG. 9 is a perspective view showing a paddle wheel in a stapling tray.

Also, a paddle wheel 180 for aligning sheets of copying paper transported into the stapling tray 150, the stapler 190, a guide roller 195 and a sensor SE7 for detecting the presence or the absence of copying paper are disposed at the bottom portion of the stapling tray 150. The paddle wheel 180, as shown in FIG. 9, is equipped with radially-arranged flexible blades 182 around the shaft 181 and is driven to rotate in the direction of arrow (g). The flexible blades 182 touch the surfaces of sheets to provide a transport force in a specified direction with each of the sheets so that every sheet is transported into the stapling tray 150 correctly and aligned.

The stapler 190 is a conventional electric type, wherein a receiver is disposed on the plane common to the stopper 160, and staples a corner of a bundle of copying paper stored and aligned in the stapling tray 150.

The guide roller 195 which can rotate is fixed to the bottom portion of a lever 196 which can shake and is hung from the guide plate 155, and this roller 195 is especially for preventing the leading edges of sheets stored in the stapling tray 150 from bulging.

On the other hand, the top portion of the guide plate 155, which is extended to the neighborhood of the diverting member 70, guides sheets of copying paper to the stapling tray 150 in cooperation with the guide plate 69. Right above the stapling tray 150, transport rollers 165 and 166 for transporting sheets of copying paper into the stapling tray 150 and a sensor SE4 for detecting the transported sheets.

Further, a regulating levers 156 and 157 and a neutralizing brush 158 for sheets of copying paper are provided for the guide plate 155. The regulating levers 156 and 157 come into the stapling tray 150 when solenoids SL1 and SL2 are turned on, and they can be moved to the positions shown by dashed lines in FIG. 2 respectively to regulate the sheets not to lean toward the guide plate 155 and to prevent page disorder of the sheets. The regulating levers 156 and 157 are set at the positions where the top edges of sheets stored in the stapling tray 150 are regulated thereby, according to the size of the sheets.

Next, the constitution for ejecting the stapled sheets from the stapling tray 150 is explained.

Figure 10:
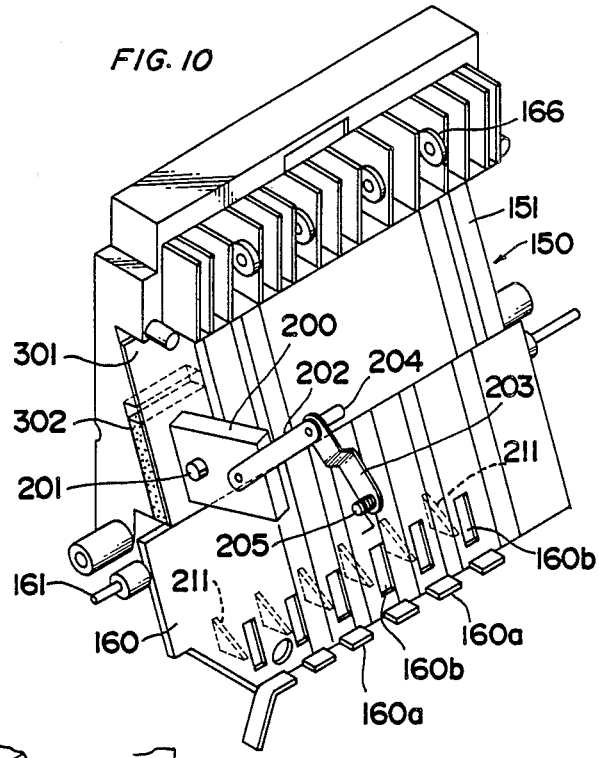
FIG. 10 is a perspective view showing the internal composition of the stapling tray including a stamp block.

A frame 210 provided for the finisher unit 50 has tabs 211 disposed at the position where the tabs 211 face the bottom portion of sheets stored in the stapling tray 150, and as shown in FIG. 10, the stopper 160 has long holes **160*b* thereon corresponding to the tabs 211. Accordingly, when the stopper 160 is turned in the direction of arrow (f) to open the bottom of the stapling tray 150, the tabs 211 protrude through the long holes 160*b* to regulate the bottom portion of the sheets. This arrangement prevents the poor ejection which may be caused by the movement of the sheets in the direction of arrow (f) attached to the bottom portion 160*a* when the bottom of the stapling tray 150 is opened. Accordingly, the regulating surfaces of the tabs 211** are inclined so as to guide the sheets to the direction of the ejection.

Also, at the time of the ejection of sheets, the paddle wheel 180 is driven to rotate so as to provide a force in the direction of the ejection with the sheets.

Further, the stapled sheets are ejected into the stack box 220 (Refer to FIG. 1) guided by a guide plate 215. In this moment, the sheets are apt to be curled in the direction of arrow (h) by the heat of the fixing device 17 in the copying machine 1, so the sheets may be stored in the stacking tray 220 out of order only with the guidance of the guide plate 215. Accordingly, in this embodiment, a protrusion 216 is arranged at the center of the guide plate 215. This arrangement provides stiffness with the sheets being ejected to the stapling tray 220 so that the paper alignment in the stack box 220 is improved.

(BUCKET BLOCK)

Figure 12:
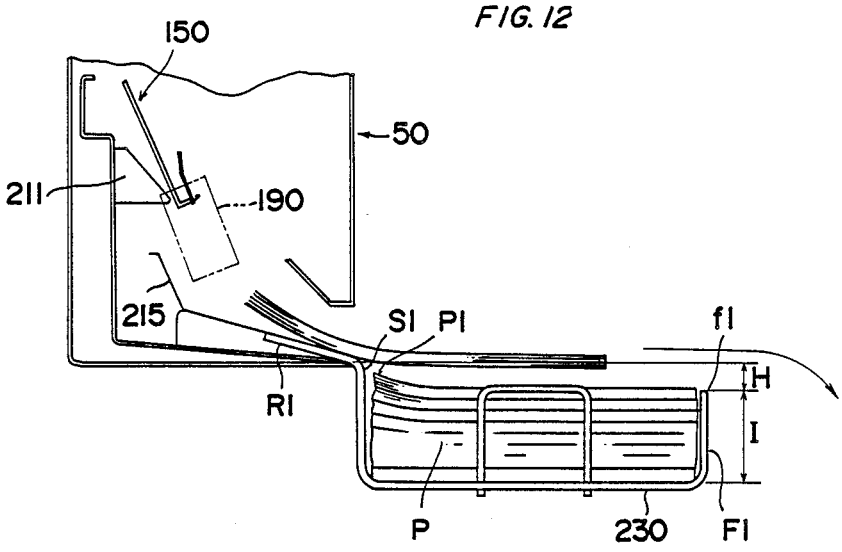
FIG. 12 is an explanatory drawing of using a stack box.

The stack box 220 composing a bucket block, as shown in FIGS. 1 and 12, extends its back portion R1 to the lower side of the guide plate 215, and the whole box is supported by the back portion R1 on one side. The stack box 220 is arranged so that the upper edge f1 of its front portion F1 can be lower than the sheet ejection portion S1 of the guide plate 215 at a distance H. The distance H is determined so that when a bundle of paper is transported on the stack of copying paper P in the stack box 220, and the stack box 220 is filled within its storage capacity, the upper surface of the stacked paper P (the trailing edge P1 of the stack of paper P which is curled upward) is still lower than the sheet ejection portion S1.

Also, in setting the depth I of the stack box 220, they are taken in consideration that a bundle of paper being transported into the stack box 220 through the guide plate 215 can be stacked in alignment without being curlet or curved and that the stacked paper P therein can be easily taken out. In this embodiment, the depth I is 60 millimeters.

Since the stack box 220 is provided, a bundle of paper goes slightly downward through the guide plate 215 to the stack box 220, bumped on the front portion F1 and falls into the stack box 220. When a specified volume of paper (which comes to the limit of its storage capacity) is stacked, the next coming bundle of paper passes through the surface of the stacked paper P by the falling energy of the bundle from the stapling tray 150, jumps out of the stack box 220. Since the distance where the bundle falls from the stack box 220 at the moment is short, the bundle of paper is almost never hurt. However, another stack box may be set outside of the stack box 220 in case. Even when the stack box 220 is filled, neither collision between of bundles of paper nor a jam happens, so that the operation of the copying machine 1 is continued.

Figure 13:
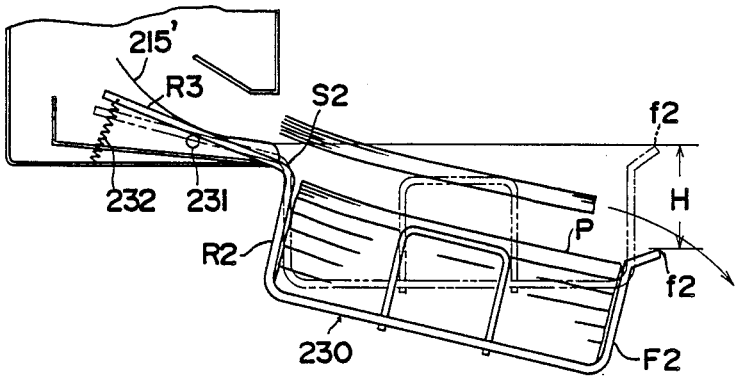
FIG. 13 is an explanatory drawing of using another modified stack box.

Also, a stack box 230 shown in FIG. 13 can be provided. The stack box 230 is like a basket, too, but the upper edge of its front portion F2 is opened outward. Initially, the stack box 203 is at the position shown a two-dot chain line in FIG. 13, and at that time, the upper edge f2 of its front portion F2 is at the same height as that of the sheet ejection portion S2 of the guide plate 215', an edge R3 of its back portion R2 is extended to the lower side of the guide plate 215' and is on a shaft 231, and further extended to a spring 232 so as to be connected to the frame of the finisher unit 50 and thereby supported. Thus, the stack box 230 is supported on one side. When a bundle of paper is transported into the stack box 230, the leading edge of the bundle is bumped on the front portion F2 and falls into the stack box 230. The more bundles of paper are stacked into the stack box 230, the more the stack box 230 is moved downward against the elasticity of the spring 232. As shown by a solid line in FIG. 13, when the stack box 230 is filled with bundles of paper P, the upper edge f2 of its front portion F2 is already lower than the sheet ejection portion S2 of the guide plate 215'. Thus and so, the coming bundles thereafter pass through the stack box 230 and fall outside. Therefore, the operation of the copying machine 1 is continued.

Further, as shown in FIGS. 2 and 11, when the protrusion 216 is provided for the guide plate 215, the height of the sheet ejection portion S1 of the guide portion, which is composed the guide plate 215 and the protrusion 216, is set same as that of the sheet ejection portion S1 of the guide plate 215 which does not have the protrusion 216.

(OPERATION MODE)

The finisher unit 50 as constructed above can be operated in a non-stapling mode, a stapling mode and a stapling and stamping mode.

The non-stapling mode is an operation mode wherein sheets of copying paper ejected from the copying machine 1 are stacked onto the ejection tray 80. In this mode, the diverting member 70 maintains its position at that shown by a solid line in FIG. 2 so that the sheets are ejected onto the ejection tray 80 through the ejection rollers 95 and the balls 67 and aligned by the rotation of the paddle wheels 99. Then, the elevate block 130 is operated as described above each time the sensor SE3 detects the upper surface of copying paper stacked onto the ejection tray 80 so that the height from the upper surface of copying paper to the nip portion formed of the ejection rollers 95 and the balls 67 is fixed.

The shifting of the ejection tray 80 by the operation of the shift block 90 is automatically performed when the number of copy sets to be made is designated more than "2", whether the RDH 30 is used or not. In such a case, each time the sensor SE2 detects the last sheet of a copy set being ejected after the completion of one cycle of copying operation, the ejection tray 80 is shifted right or left for the division of copying paper into sets.

The stapling mode is an operation mode wherein sheets of copying paper ejected from the copying machine 1 are stored in the stapling tray 150 to be stapled with the stapler 190 and the stapled sheets are ejected therefrom and stacked in the stack box 220. In this mode, the diverting member 70 is set at the position shown by a dashed line in FIG. 2 so that the sheets are transported into the stapling tray 150 through the transport rollers 165 and aligned by the rotation of the paddle wheel 180. Then, when the last sheet of a set of copying paper corresponding to a set of original documents finishes to be aligned, the stapler 190 is driven.

The stamping mode is an operation mode wherein the stamp 200 stamps on the first page of a bundle of copying paper stored in the stapling tray 150. In this embodiment, the stamping mode is available only when the operation in the stapling mode and is executed right after the stapling operation. In this case, the elevate frame 131 is moved down together with the ejection tray 80 by the operation of the elevate block 130 until the corner **131*b* of the elevate frame 131 is detected by the sensor SE6, and then the stamp 200 is moved to stamp by the cooperation of the links 202 and 203** with each other. In this moment, the stamp receiving position supports the back side of a bundle of paper to contribute to the clear stamping.

The finisher unit 50 has the following advantages.

1. The aligning operation, the stapling operation and the stamping operation can be performed in one stapling tray 150, so that the space can be saved more compared with the space for an apparatus performing the above processing separately or one performing only a part of the processing.

2. The stamping operation is performed on the aligned and stopped sheets, so that the stamping position is not skewed.

3. Since the stapling tray 150 is provided with the stamp receiving position made of elastic material, the clear stamping operation can be always performed without being affected by a slight error in disposing the stamp, the curl of sheets, the volume of the sheets stored in the tray 150, and the elastic stamp receiving position is effective especially when a small amount of paper is stamped on.

4. In the viewpoint as mentioned in 3, the stamp 200 does not need to be specially precise, so that the cost for making and disposing the stamp is cheaper.

5. The stamp receiving position is made of material to reduce friction, and its smooth surface is positioned at the same height as that of the surface of the sheet receiving portion of the stapling tray 150, so that the reception of sheets by the tray 150, the alignment of sheets in the tray 150, the ejection of sheets therefrom are never obstructed.

6. Since neither the stack box 220 no 230 needs to be provided with an elevate device and sensors, the constitution of them is simple, and the cost for making them is cheaper.

7. Each of the stack boxes 220 and 230 is arranged so that when a specified volume of copying paper is stored therein, the coming bundles of paper thereafter pass through the surface of the stack of paper to go outside of the stack box. Accordingly, collision between sheets in each stack box which may cause a paper jam does not occur, and the operation of the copying machine is continued, so that the copying operation and the stapling operation can be performed efficiently.

8. Since each of the stack boxes 220 and 230 is shallow, bundles of copying paper can be stably stacked therein, and the stacked bundles can be easily taken out therefrom. Also, the volume of copying paper which can be stored in each box is small, so that even when each stack box is supported by the finisher unit, the finisher unit is not burdened much, and the appearance can give a light image.

(CONTROL PANEL)

Figure 14:
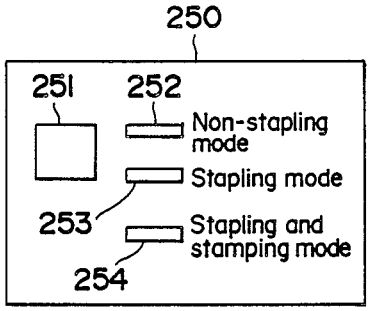
FIG. 14 is a plan view showing an operation panel of the finisher unit.

Regarding control panels, in this embodiment, a control panel 250 of the finisher unit 50 (Refer to FIG. 14.) are installed. The control panel 250 comprises a mode selection key 251, an LED 252 for indicating the non-stapling mode, an LED 253 for indicating the stapling mode and an LED 254 for indicating the stapling and stamping mode. When a power switch is turned on, the operation mode is reset at the non-stapling mode. Thereafter, each time the mode selection key 251 is pressed, the operation mode is orderly changed to the stapling mode, to the stapling and stamping mode and then to the non-stapling mode, and the corresponding LEDs 252, 253 and 254 are accordingly lighted.

(CONTROL CIRCUIT)

Figure 15:
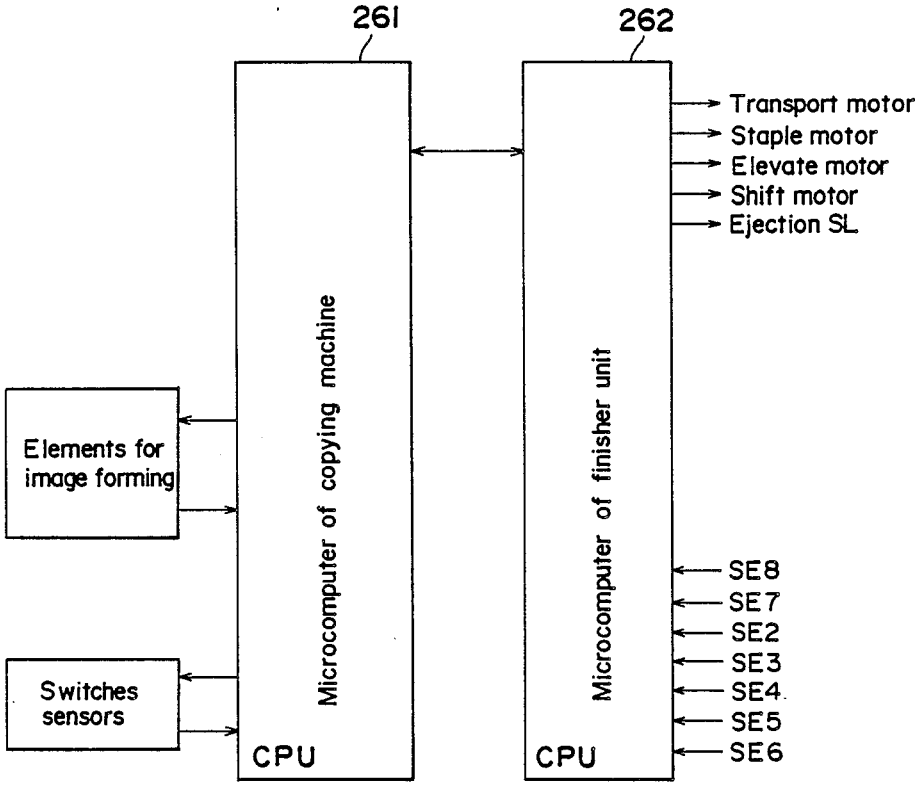
FIG. 15 is a block diagram showing a control circuit.

FIG. 15 shows a control circuit of the copying machine 1 and the finisher unit 50.

The control is executed mainly by a microcomputer (which is hereinafter referred to as CPU) 261 of the copying machine 1 and a CPU 262 of the finisher unit 50. The CPU 261 is connected to all elements for image forming and many of the switches and the sensors. The CPU 262 is connected to the transport motor, the staple motor, the elevate motor, the shift motor, the paddle wheel motor, the ejection solenoid etc. and the sensors SE2 through SE8. The CPU 261 exchanges signals with the CPU 262 to execute the necessary processing.

(CONTROL PROCEDURE)

The control procedures of the copying machine 1 and the finisher unit 50 based on the control circuit are herewith explained.

In the following paragraphs, the term "on-edge" is defined as change in status where a switch, a sensor, a signal or the like changes from the off status to the on status. In contrast, the term "off-edge" represents change in status where a switch, a sensor, a signal or the like changes from the on status to the off status. Further, the sensors SE1, SE2 and SE4, which have points of contact, are turned on when they detect sheets of copying paper, and the photosensors SE5, SE6 and SE7, which do not have any points of contact, are turned off when sheets of copying paper or the like intercept their optical axes.

Figure 16:
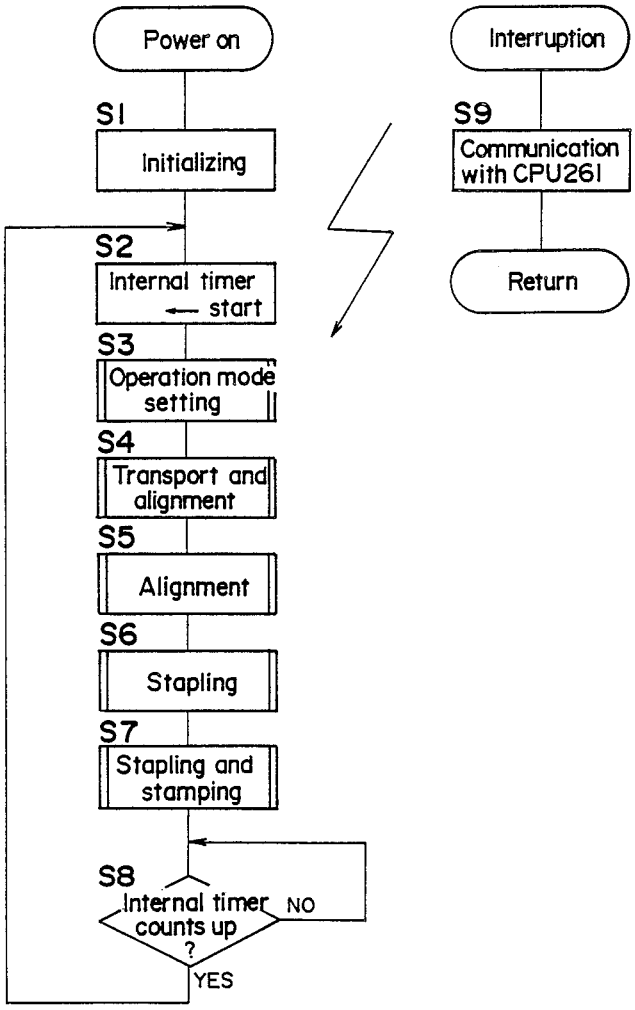
FIG. 16 is a flow chart showing a main routine of a CPU 262.

FIG. 16 shows a main routine which the CPU 262 of the finisher unit 50 performs.

When the CPU 403 is all reset, and the program is started, first, at step S1, a random access memory is cleared and every register is initialized to reset all devices at the initial mode. Next, an internal timer is started at step S2. The internal timer determines the time required for one cycle of this main routine, and the numerical value is predetermined at step S1.

Subsequently, subroutines to be executed at steps S3 through S7 are called and executed, and when the processes of all the subroutines are completed, it is confirmed at step S8 that the internal timer counts up the time, and then the processing returns to step S2. The counting with each timer in each subroutine is based on the time required for one cycle of this main routine.

Step S3 is a subroutine for the setting of the operation mode of the finisher unit 50 by an operator. Step S4 is a subroutine for the transport and alignment of copying paper onto the ejection tray 80 when the non-stapling mode is selected. The detailed description of this subroutine is omitted. Step S5 is a subroutine for the transport and storing of copying paper into the stapling tray 150 and the alignment of each sheet therein when the stapling mode or the stapling and stamping mode is selected, and at this step, an alignment flag is set at "1" simultaneously with the completion of the alignment of one set of copying paper. The detailed description of this subroutine is omitted. Step S6 is a subroutine for the stapling operation to staple one set of copying paper already aligned in the stapling tray 150 and the ejection of the bound paper into the stack box 220. Step S7 is a subroutine for the stamping on the bound paper with the stamp 200.

On the other hand, when a request for the interruption operation is outputted from the CPU 261 of the copying machine 1 in the middle of the procedure of this main routine, the CPU 262 of the finisher unit 50 corresponds with the CPU 261 at step S9.

Figure 17:
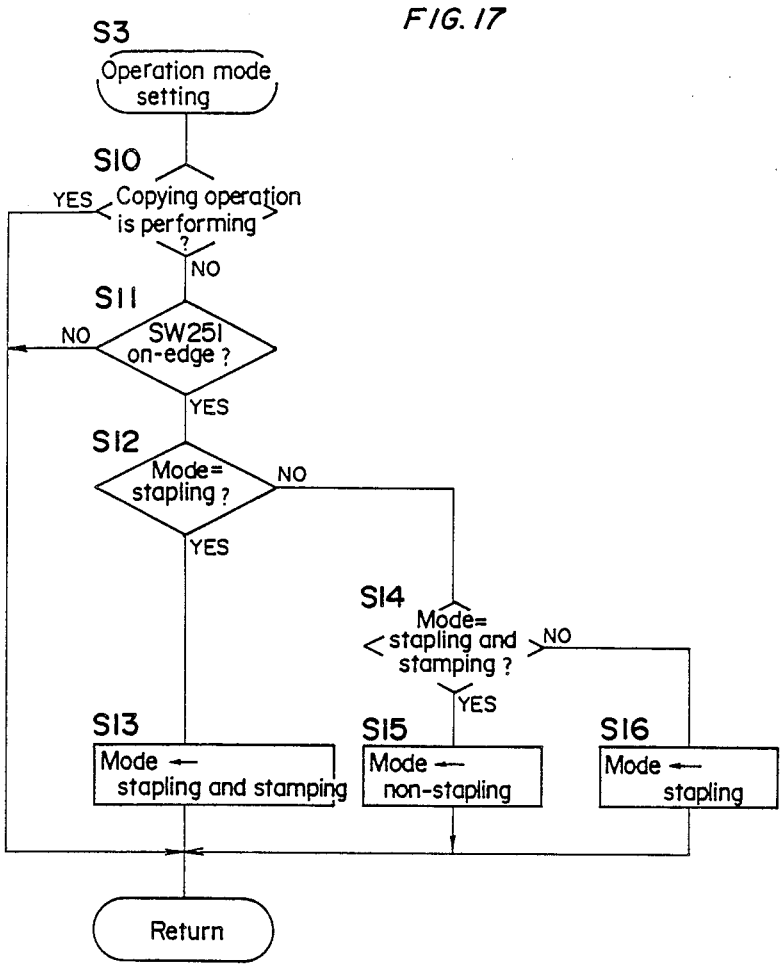
FIG. 17 is a flow chart showing a subroutine for the operation mode setting.

FIG. 17 shows a subroutine for the operation mode setting be executed at step S3.

After it is confirmed at step S10 that the copying machine 1 is not currently in operation, it is checked at step S11 whether the mode selection switch 251 is on-edge or not. If it is on-edge, it is checked at steps S12 and S14 whether the current operation mode is either the stapling mode or the stapling and stamping mode or neither.

If the operation mode is the stapling mode at this moment, at step S13, the LED 254 is lighted while the mode is changed to the stapling and stamping mode. If the operation mode is the stapling and stamping mode, at step S15, the LED 252 is lighted while the mode is changed to the non-stapling mode. If the operation mode is the non-stapling mode, that is, if both of the results at steps S12 and S14 are "NO", at step S16, the LED 253 is lighted while the mode is changed to the stapling mode.

Figure 18:
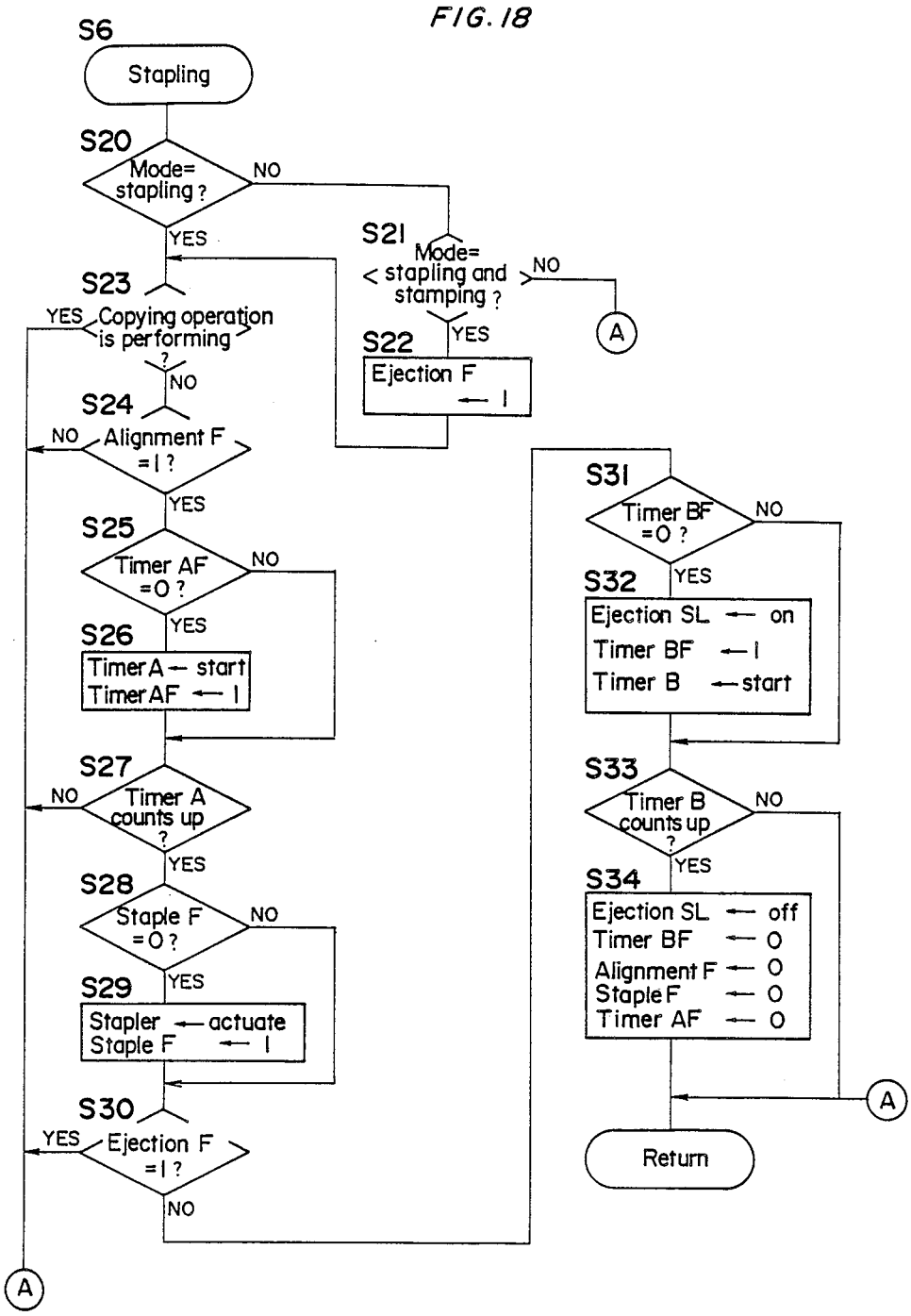
FIG. 18 is a flow chart showing a subroutine for the stapling operation.

FIG. 18 shows a subroutine for the operation in the stapling mode to be executed at step S6 of the main routine.

First, whether the stapling mode is designated as the operation mode or not is checked at step S20, and whether the stapling and stamping mode is designated or not is checked at step S21. If the stapling mode is designated, after it is confirmed at step S23 that the copying machine 1 is not in operation, it is checked at step S24 whether the alignment flag is at "1" or not. On the other hand, if the stapling and stamping mode is designated, an ejection flag is set at "1" at step S22, and the processing orderly goes to steps S23 and S24. The ejection flag is kept at "1" during the stamping operation for the purpose of delaying the ejection of the sheets from the stapling tray 150 so that the stamping operation is executed after the stapling operation.

The alignment flag is set at "1" at step S5 when one set of copying paper is finished to be aligned in the alignment subroutine. So, if the alignment flag is at "1", it is checked at step S25 whether a timer A flag is at "0" or not. If it is at "0", at step S26, a timer (A) is started and the timer A flag is set at "1". The timer (A) determines the timing at which the stapler 190 is driven.

Next, after it is confirmed at step S27 that the timer (A) counts up the time, it is checked at step S28 whether a staple flag is at "0" or not. If it is at "0", the staple motor is turned on at step S29 in order to actuate the stapler 190 to staple the sheets, and simultaneously the staple flag is set at "1".

Next, it is checked at step S30 the ejection flag is at "1" or not. If it is at "1", the processing returns to the main routine to execute the stamping operation. If the ejection flag is at "0", since only the stapling operation is necessary, it is checked at step S31 whether a timer B flag is at "0" or not. If it is at "0", at step S32, the ejection solenoid is turned on. Thereby, the stopper 160 retreats to open the bottom of the stapling tray 150, and the stapled sheets are ejected into the stack box 220. Further, at step S32, the timer B flag is set at "1", and a timer (B) is started. The timer (B) determines the timing at which the stapling tray 150 returns to its initial state in the stapling mode.

When it is confirmed at step S33 that the timer (B) counts up the time, at step S34, the ejection solenoid is turned off, the timer A flag and the timer B flag are reset at "0", the alignment flag and the staple flag is reset at "0". Thus and so, one cycle of stapling operation is completed.

Figure 19:
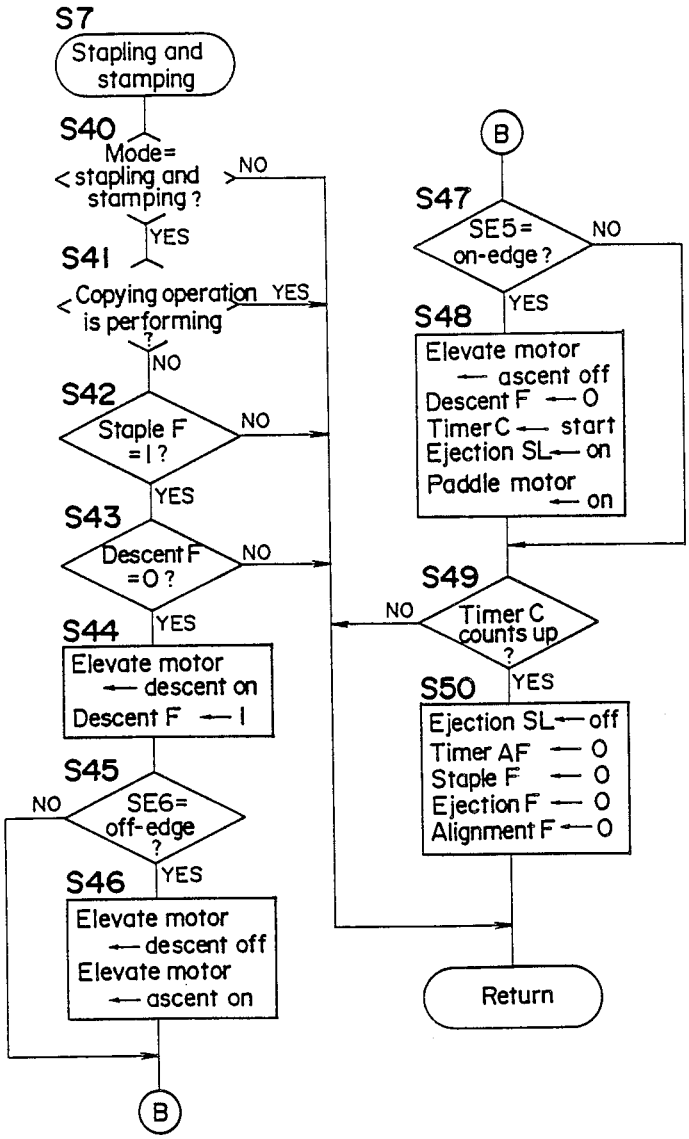
FIG. 19 is a flow chart showing a subroutine for the stapling and stamping operation.

FIG. 19 shows a subroutine for the operation in the stapling and stamping mode to be executed at step S7 of the main routine.

This subroutine is executed continuously after the ejection flag is judged to be at "1" at step S30 of the above-described stapling mode subroutine. Consequently, when this subroutine is to be executed, the sheets in the stapling tray 150 has been already stapled, and the staple flag is kept at "1".

In this subroutine, first, it is checked at step S40 whether the stapling and stamping mode is designated or not. If it is judged "YES", after it is confirmed at step S41 that the copying machine 1 is not in operation, it is checked at step S42 whether the stapling flag is at "1" or not. If it is at "1", which means that the stapling operation has been completed, the stamping operation is executed as described below.

It is checked at step S43 whether a descent flag is at "0" or not. If it is at "0", at step S44, the elevate motor is driven to move down the ejection tray 80, and simultaneously the descent flag is set at "1". Subsequently, it is checked at step S45 whether the sensor SE6 is off-edge or not. The off-edge of the sensor SE6 means that the corner **131*b* of the elevate frame 131 has been moved down to be detected by the sensor SE6, and the stamp 200 has been moved in the direction of arrow (e) to stamp on the sheets. Accordingly, if the sensor SE6 is judged off-edge at step S45, the elevate motor is reversed at step S46 to change the movement of the ejection tray 80** from downward to upward.

Next, it is checked at step S47 whether the sensor SE5 is on-edge or not. The position of the ejection tray 80 when the sensor SE5 is turned on is its initial position in the stamping mode. If the sensor SE5 is on-edge, the elevate motor is turned off at step S48 to stop elevating the ejection tray 80, and the descent flag is reset at "0". Simultaneously, a timer (C) is started, the ejection solenoid is turned on. Thereby, the stopper 160 retreats to open the bottom of the stapling tray 150, and the sheets stapled and stamped by the stamp 200 are ejected into the stack box 220. The timer (C) determines the timing at which the stapling tray 150 recovers its initial state in the stapling and stamping mode.

After it is confirmed at step S49 that the timer (C) counts up the time, at step S50, the ejection solenoid is turned off, the timer A flag, the staple flag, the ejection flag and the alignment flag are reset at "0" respectively. Thus and so, one cycle of stapling and stamping operation is completed.

Although the present invention has been described in connection with the preferred embodiment thereof, it is to be noted that various changes and modifications are apparent to those who are skilled in the art. Such changes and scope of the present invention as defined by the appended claims, unless they depart therefrom.

Especially, regarding the mechanism for connecting the stamping operation by the stamp 200 with the descent of the ejection tray 80, the mechanism that the tab 135 of the elevate frame 131 presses the stamp 200 to stamp on sheets, the mechanism that a pinion gears to a rack formed on the elevate frame 131 and the revolution of the pinion is changed into the reciprocation of the stamp 200 by linking means, or the like is available as well as the above-mentioned mechanism with use of links 202 and 203.

What is claimed is:

1. A sheet handling apparatus, comprising:

a tray for receiving sheets ejected from an image forming apparatus;

means for aligning the sheets transported onto said tray;

means for stapling the sheets aligned by said aligning means;

means for stamping on the sheets which are in said tray; and means for controlling said stamping means to be driven after the operation of said stapling means.

2. A sheet handling apparatus as claimed in claim 1, wherein said stamping means is composed of a stamp and means for reciprocating said stamp toward said tray.

3. A sheet handling apparatus, comprising:

a tray for receiving sheets ejected from an image forming apparatus;

means for aligning the sheets transported onto said tray;

means for stapling the sheets aligned by said aligning means; and means for stamping on the sheets which are in said tray, said stamping means being composed of a stamp and means for reciprocating said stamp toward said tray;

wherein the surface of said tray facing said stamp is made of soft and elastic material to reduce friction.

4. A sheet handling apparatus as claimed in claim 3, further comprising:

means for controlling said stamping means to be driven after the operation of said stapling means.

5. A sheet handling apparatus comprising:

a first tray for receiving sheets ejected from an image forming apparatus;

a second tray for receiving sheets ejected from an image forming apparatus;

means for transporting the sheets selectively to said first tray or said second tray;

elevate means for elevating and lowering said first tray to and from the ejection portion where sheets are ejected by said transport means;

means for stapling the sheets received by said second tray therein;

means for stamping on the sheets which are in said second tray; and connecting means for driving said stamp to stamp on the sheets in connection with the movement of said first tray driven by said elevate means.

6. A sheet handling apparatus as claimed in claim 5, further comprising means for controlling said stamping means to be driven after the operation of said stapling means.

7. A sheet handling apparatus as claimed in claim 5, wherein said stamping means is composed of a stamp and means for reciprocating said stamp toward said second tray, and said stamp is moved toward said second tray by said connecting means in connection with the descent of said first tray.

8. A sheet handling apparatus as claimed in claim 7, wherein the surface of said second tray facing said stamp is made of soft and elastic material to reduce friction.

9. A sheet handling apparatus, comprising:

a tray for receiving sheets ejected from an image forming apparatus;

means for stapling the sheets received by said tray therein;

means for stamping on the sheets which are in said tray;

means for selecting one of a stamping mode in which the sheets are stamped on by said stamping means, a stapling mode in which the sheets are stapled by said stapling means and a non-stapling mode in which neither said stamping means nor stapling means is actuated; and control means for actuating said stapling means as well as said stamping means when the stamping mode is selected.

10. A sheet handling apparatus as claimed in claim 9, wherein said stamping means is actuated after the operation of said stapling means.

* * * * *